US006874724B2

(12) United States Patent
Muller et al.

(10) Patent No.: US 6,874,724 B2
(45) Date of Patent: Apr. 5, 2005

(54) METHOD AND DEVICE FOR REELING UP IN THE PROPER POSITION A HOT-ROLLED STRIP IN A REELING INSTALLATION

(75) Inventors: Ulrich Muller, Monheim (DE); Andreas Wolff, Dusseldorf (DE); Gerd Thiemann, Bochum (DE); Michael Degner, Dortmund (DE)

(73) Assignees: BFI VDeh-Institute fur angewandte Forschung GmbH (DE); Thyssen-Krupp Stahl AG (DE)

( * ) Notice: Subject to any disclaimer, the term of this patent is extended or adjusted under 35 U.S.C. 154(b) by 0 days.

(21) Appl. No.: 10/240,051

(22) PCT Filed: Mar. 22, 2001

(86) PCT No.: PCT/EP01/03251

§ 371 (c)(1),
(2), (4) Date: Jan. 10, 2003

(87) PCT Pub. No.: WO01/72444

PCT Pub. Date: Oct. 4, 2001

(65) Prior Publication Data

US 2003/0102401 A1 Jun. 5, 2003

(30) Foreign Application Priority Data

Mar. 27, 2000 (DE) ..... 100 14 813

(51) Int. Cl.[7] ..... B65H 23/02

(52) U.S. Cl. ..... 242/534.1; 242/418.1; 226/21; 226/22; 226/23; 226/184

(58) Field of Search ..... 242/418.1, 534, 242/534.1, 563, 563.1; 221/21–23, 180, 184

(56) References Cited

U.S. PATENT DOCUMENTS 4,759,205 A * 7/1988 Kuwano et al. ..... 72/9.3
5,433,253 A * 7/1995 Toda et al. ..... 139/1 B
5,798,925 A * 8/1998 Poling ..... 700/123
5,964,114 A 10/1999 Noe et al.
6,371,400 B1 * 4/2002 Morimoto et al. ..... 242/532.2
6,604,663 B2 * 8/2003 Kuwano et al. ..... 226/177

FOREIGN PATENT DOCUMENTS

| | | | | |
|---|---|---|---|---|
| DE | 3828356 A | | 2/1990 | |
| EP | 0864847 A | | 9/1998 | |
| JP | 56028151 A | * | 3/1981 | ..... B65H/23/02 |
| JP | 59183930 A | | 10/1984 | |
| JP | 61017324 A | * | 1/1986 | ..... B21C/47/02 |
| JP | 61126925 A | * | 6/1986 | ..... B21C/47/02 |
| JP | 63132718 A | * | 6/1988 | ..... B21C/47/00 |
| JP | 05138249 A | * | 6/1993 | ..... B21C/47/34 |
| WO | PCT/EP01/03251 | | 7/2001 | |
| WO | PCT/EP01/03251 | | 2/2002 | |

* cited by examiner

*Primary Examiner*—Eileen D. Lillis
*Assistant Examiner*—Sang Kim
(74) *Attorney, Agent, or Firm*—Cook, Alex, McFarron, Manzo, Cummings & Mehler, Ltd.

(57) ABSTRACT

The invention relates to a method and a device for the positionally correct winding up of a metal strip in a coiling device, the hot strip being fed to the coiling device by a driving device with driving rollers, the driving rollers being tiltable in relation to one another by a controller by means of actuators for changing the gap between the driving rollers, and the controller being fed the position of the edge of the hot strip upstream of the driving device as a measured variable and as a setpoint reference variable, an optimization of the winding result of the rolled strip coil being achieved by the surface geometry of the rolled strip being determined as a measured variable and fed to the controller.

12 Claims, 3 Drawing Sheets

METHOD AND DEVICE FOR REELING UP IN THE PROPER POSITION A HOT-ROLLED STRIP IN A REELING INSTALLATION

FIELD OF INVENTION AND CROSS REFERENCE TO RELATED APPLICATIONS

The invention relates to a method for the positionally correct winding up of a metal strip, in particular a rolled hot strip, in a coiling device, the hot strip being fed to the coiling device by a driving device with driving rollers, the driving rollers being tiltable in relation to one another by a controller by means of actuators for changing the gap between the driving rollers and the resultant influencing of the lateral position of the hot strip, and the controller being fed the position of the edge of the hot strip upstream of the driving device as a measured variable and as a setpoint reference variable, and claiming the priority of German Patent Application 100 14 813.1-32, to the content of which reference is made.

Furthermore, the invention relates to a device for the positionally correct winding up of a rolled hot strip in a coiling device, with a driving device with driving rollers feeding the hot strip to the coiling device, with actuators and a controller for them, for changing the gap between the driving rollers and the resultant influencing of the lateral position of the hot strip, and with a measuring device for determining the position of the edge of the hot strip upstream of the driving device, the measured values of which are fed to the controller.

BACKGROUND OF THE INVENTION

It is generally known that, in hot strip rolling, after it runs out of the last stand of the finishing train, the finish-rolled hot strip is transported from the delivery table through a cooling line, preferably a system of spray-water nozzles, to a coiling device. The hot strip is wound up by the coiling device into coils. In the region upstream of the coiling device, the hot strip may be guided on the delivery table by side guide shoes, which can be hydraulically adjusted laterally onto the strip edges, in order to align the rolled hot strip for running into the coiling device. In a corresponding way, the side guide shoes are in contact with the strip edges of the hot strip during the coiling operation.

Arranged at the end of the delivery table is a driving device, which substantially comprises a lower driving roller, which is mounted in the frame of the coiling device, and an upper driving roller, which is mounted in a driver rocking arm. The upper driving roller can be pivoted by means of hydraulic cylinders for setting and adjusting the gap between the driving rollers. With the aim of stabilizing the running of the strip, convex lower driving rollers or else driving rollers with a cylindrical central part and respectively conical roller ends are primarily used. The main functions of the driving device, including its drives, are to tension the beginning of the rolled strip coming from the finishing train, direct the incoming tip of the strip in the direction of the coiling device and ensure the draw-back counter to the coiling device during the coiling operation.

The main components of the coiling device are an expanding mandrel for winding up the rolled strip, back-up rollers and guide trays for guiding the rolled strip during the winding operation and also a mandrel drive. The free mandrel end (coil drawing-off side) is generally supported during coiling by a mandrel bearing which can be swung in.

To initiate the winding operation, the tip of the hot strip coming from the finishing stand is deflected by the pair of driving rollers from the plane of the delivery table downward toward the winding mandrel. Then, the back-up rollers and the guide trays of the coiling device pass the beginning of the strip several times around the rotating mandrel. The mandrel comprises a number of segments, which are continuously expanded shortly after the tip of the strip arrives, until the strip is wound into lays of coil lying firmly one on top of the other with frictional engagement. The main functions of the coiling device are to ensure the frictional connection of the beginning of the strip and the mandrel, to carry the coil produced during winding and to apply defined strip tension to the strip during the winding.

Furthermore, German Offenlegungsschrift DE 38 28 356 A1 already discloses a method for influencing the position of the hot strip which is fed to a coiling device by a pair of driving rollers, and a driving device for carrying out this method. In the case of this method of controlling the strip position, the strip guidance for the coiling device takes place exclusively by an asymmetric adjustment of the gap between the driving rollers by means of a pivotable upper driving roller. For this purpose, the upper driving roller is mounted in a driver rocking arm, which has hydraulic adjustment and balancing. This also has the result that the side guide shoes are opened during the coiling operation.

The adjusting effect of this driving device with respect to the hot strip is based on a shift in the location of the point of action of the strip tensioning force and the resultant uneven elastic strip lengthening (bending) caused by pivoting of the upper driving roller. Pivoting of the upper roller leads to opening of the driver gap on one side and consequently a shift in the point of action of the pressing force which the driving rollers exert on the strip. The point of action of the force, which in the case of a symmetrical driver gap lies in the center of the installation, is now shifted by a distance from the center of the installation in the direction of the unopened side of the driver gap. As a consequence of this, the strip draw-back force resulting from the braking moment of the driving device likewise acts at a distance from the center of the installation on the strip which until then is still running centrally. This force-introducing situation brought about by the pivoting/tilting of the upper driving roller results in a moment exerted on the still centrally running strip that causes elastic transverse bending of the strip. As a consequence of this deforming of the strip, the longitudinal fibers of the strip in the region of the driving device are oriented at an angle in relation to the center axis of the installation or at an angle in relation to the axes of the driving rollers. Consequently, a strip led in frictional engagement over a driving roller tends to follow the curves of the path of the points of the roller shell in the contact region. This means in the present case that the strip does not for instance run through the driving device in a path following the longitudinal direction of the strip fibers, but instead the point of the strip located at the given instant in the contact region is transported in the direction of the circumferential speed vector of the roller at the contact point, that is in the direction of the longitudinal axis of the installation. This results in a transverse shift of the strip in the driving device. This shift of the strip also causes a gradual increase in the distance between the point of action of the driver draw-back force and the center point of the tension on the coil at the strip run-on point. However, with great tilting of the upper driving roller, the distance from the center of the installation becomes considerably greater than the transverse shifts of the strip occurring, so that the influence of the resultant change in the distance from the center of the installation can be ignored.

The strip position control system disclosed by the aforementioned German Offenlegungsschrift DE 38 28 356 A1 substantially comprises a strip edge detection system, a strip position controller and a hydraulic adjustment of the upper driving roller with force and tilt control. The influencing of the strip position takes place by the pivoting/tilting of the upper driving roller in a way corresponding to the mechanical principles described above. The system deviation for the strip position controller is formed from the position of the strip edge at the given instant, which is detected by means of strip edge scanning, and the setpoint position value, which is determined from the strip width and the dimensions of the installation. The output variable of the strip position controller is the setpoint value of the driving roller tilt, which is prescribed for the driving roller adjustment. Since no contact occurs between the shoes and the strip when the side guide shoes are open, both the customary wearing of the shoes and damage to the edges of the strip caused by the side guide shoes are avoided.

Operational tests have shown that strip guidance by the driving device with the side guide shoes open is possible in principle for hot rolled strips up to a thickness of approximately 5 mm. However, the quality requirements for the wound state are not completely satisfied with this method. The contour of the coil end face showed limited but inadmissible residual undulations (range of variation around ±10 mm). During unthreading from the finishing stand, winding offsets occur. The following causes are decisive for these defects, i.e. for the lateral shearing out of lays of coil:

Essential for the function of the driving device as an actuator for the strip position controller is the influencing of the delivery angle of the strip (angle between strip center line and driving roller axis). In the case of curved strips ("sabre form"), the angle caused by the curvature has the effect of a disturbance, i.e. the angle from the strip curvature is not taken into account when generating the manipulated variable and falsifies the latter in an initially undetected magnitude.

Since the armature current of the driving roller drives is controlled by the higher-level drive control, and can consequently also be limited, if a current limit that is too low is prescribed, the resultant tension in the strip between the mandrel and the driving device is too low, so that the aimed-for actuating effect cannot be achieved by pivoting the upper driving roller in order to drive the strip into the setpoint position.

An abrupt relaxation of the tension of the strip also takes place when the strip is unthreaded from the finishing stand, which can cause instances of slippage in the driver gap and consequently cause a winding offset in the coil.

Furthermore, a method for measuring the surface geometry of hot strip by generating lines on the strip surface by means of a light source is described in German Patent DE 197 09 992 C1. This method is intended to make simple and effective detection of the flatness of the strip possible, in order to use this for a more sensitive control of rolling and coiling parameters. A pattern of lines is projected by means of a slide projector on the measuring surface, the hot strip or the end face of a coil in the process of being produced, and is detected by means of a CCD camera (charge coupled device). The projector is in this case arranged above the hot strip and projects the pattern of lines at an angle to the vertical onto the surface of the hot strip, so that the lines preferably extend transversely in relation to the surface of the strip and consequently cover the entire width of the strip.

The CCD camera detects the lines running transversely over the surface of the strip. If the strip is absolutely flat, a uniform pattern of straight lines with unchanged line spacing is produced. Deviations of the surface of the strip from the ideal plane cause a change in the line spacing in the region of the unevenness. This change is detected by the camera and can be computationally converted in a simple way into differences in height by a comparison with a reference pattern. In a way similar to measuring flatness on the running strip, the measuring system can be used to monitor the flatness of the end faces during coiling. The end face of the coil building up in the coiler in this case corresponds to the surface of the strip. This measuring method makes possible a rapid online determination of the actual differences in height of the surface of the strip and consequently allows real-time detection and control of continuous portions of strip. This has the advantage that the measurement results allow the rolling and/or coiling parameters to be adapted immediately after an unevenness occurs. Even a transverse convexity of the strip can be determined in this way. Conventional measuring systems detect only the fiber length of the strip. What is more, the measuring lines can be adapted with respect to their intensity and line thickness to different conditions.

To sum up, it is consequently found that there continue to be occurrences of lateral shearing out of lays of coil during the coiling up of rolled strip, which are caused by transverse movements of the rolled strip to be coiled up and lead to uneven end faces of the coil. In the course of the further processing and transporting of such coils, the protruding strip edges are susceptible to damage. Owing to these instances of damage, additional costs may arise in further processing or losses in revenue may occur. In addition, the conventional way, described at the beginning, of guiding the rolled strip during coiling by means of side guide shoes entails relatively high expenditure on maintenance, since the side guide shoes are subject to increased abrasive wear by the strip edges of the rolled strip to be guided.

BRIEF SUMMARY

The present invention is based on the object of providing a method and a device for the positionally correct winding up of a hot strip into a coiling device, with which an optimization of the winding result of the rolled strip coil is achieved. It is primarily intended for instances of lateral shearing out of the individual lays of coil of the rolled strip during coiling to be avoided and for the wound coil to correspond to DIN requirements, such as firmly wound, as round as possible and with straight edges. The limit dimensions for a coil in the wound state are specified in DIN 1016.

This object is achieved by a method for the positionally correct winding up of a rolled hot strip in a coiling device by the surface geometry of the rolled strip being determined as a measured variable and fed to the controller. With respect to the device for the positionally correct winding up of a hot strip in a coiling device, this object is achieved by the arrangement of a measuring device for determining the surface geometry of the rolled strip in the region upstream of the driving device, the measured variable of which device is fed to the controller. Advantageous refinements of the method according to the invention and the device are specified in the subclaims.

The method according to the invention for the positionally correct winding up of a hot strip in a coiling device and its associated device can be designed in a multi-variable strip position control system with pilot control, that substantially comprises a measuring system for detecting the surface geometry of the strip and the position of the strip edge, a multi-variable controller for the strip tension and the strip position, a pilot control, which takes into account the influence of the surface geometry of the incoming strip, an observer for appraising the strip position on the coil and the strip tension between the driver and the mandrel and also a hydraulic adjustment of the upper driving roller by a force and tilt control.

The method for the positionally correct winding up of a hot strip into a coiling device and its associated device can be advantageously retrofitted into existing installations by using the existing actuators (adjustment of the driving rollers, drives of the driving apparatus and mandrel) and the measuring device for determining the strip position and the surface geometry of the strip.

It is particularly advantageous that the reference variable for the strip tension of the driving device is dimensioned such that the complete takeover of the draw-back by the driving device when the rolled strip is unthreaded from the last stand of the finishing train does not take place abruptly, but instead a steadily differentiatable increase up to full takeover of the tension already takes place before the end of the strip is unthreaded from the finishing stand. As a result, winding offsets in the coil are successfully avoided.

The main advantages of the method and of the device according to the invention are that the surface geometry of the strip in the entry to the coiling device are predictively taken into account by a pilot control, the position of the strip on the coil is appraised by observers using verifiable physical models and the strip tension is optimized, taking into account the surface geometry of the incoming strip and the strip position at the given instant.

The invention is explained in more detail below on the basis of an exemplary embodiment of the represented in the drawing, in which:

DETAILED DESCRIPTION OF THE INVENTION

Figure 1:
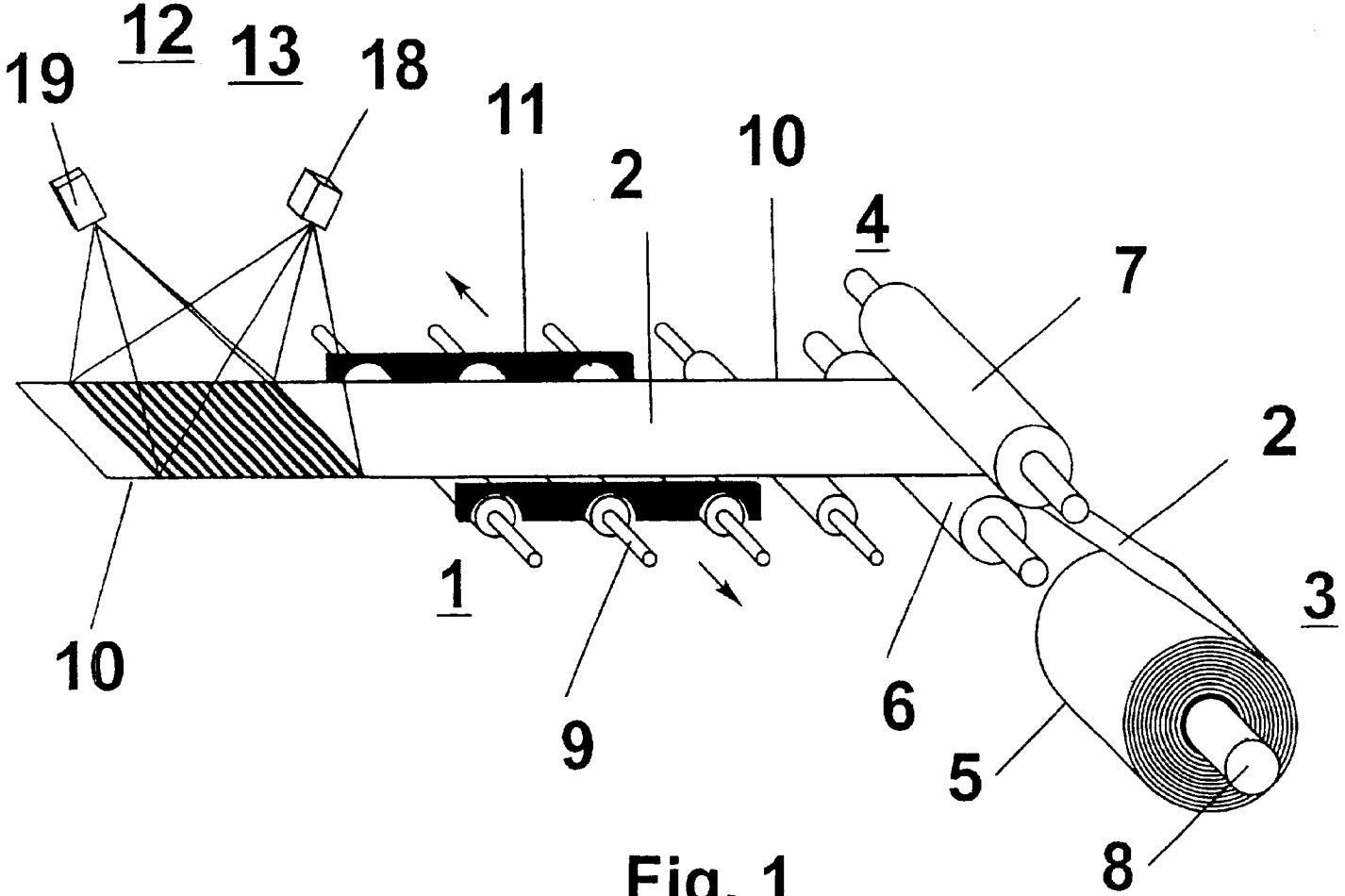
FIG. 1 shows a side view of an end portion of a delivery table with an adjoining driving and coiling device for a hot strip.
Figure 2:
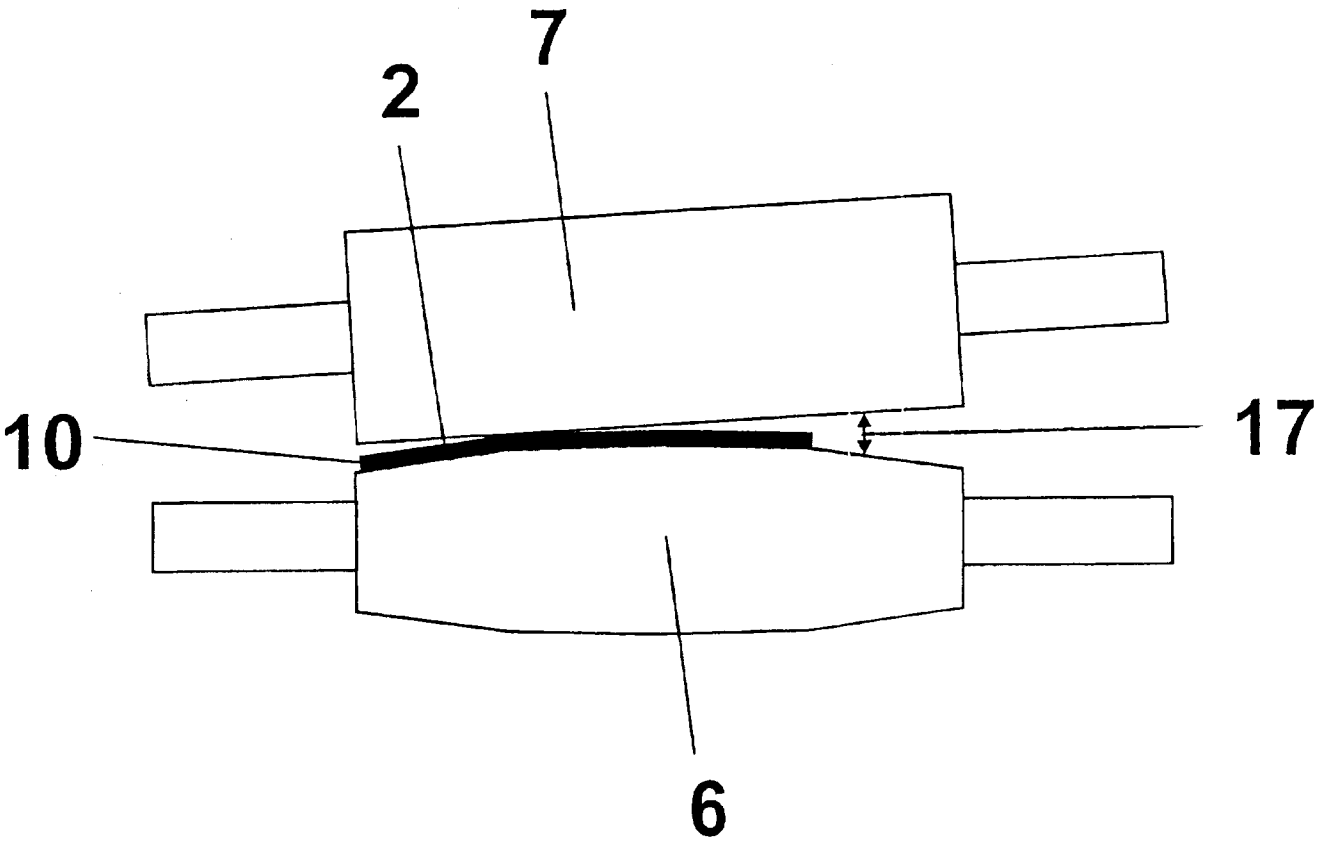
FIG. 2 shows a view of a detail of the driving rollers of the driving device and FIG. 3 shows a block diagram of a control loop for a multi-variable control of the strip position of a hot strip in the region of a coiling device.

FIG. 1 shows a schematic side view of an end portion of a delivery table 1, which is connected on the input side to a finishing stand (not represented) of a hot strip train. On the delivery table 1, a finish-rolled hot strip 2 is transported in the direction of a coiling device 3 with an upstream driving device 4. The hot strip 2 can be wound up by the coiling device into coils 5. The driving device 4 arranged at the end of the delivery table 1 substantially comprises a lower driving roller 6 and an upper driving roller 7. The upper driving roller 7 can be adjusted in the direction of the lower driving roller 6 and laterally tilted by hydraulic piston/cylinder units (not represented) for setting and adjusting the gap between the driving rollers 6 and 7. In FIG. 2, which is a view of a detail of the driving rollers 6 and 7 of the driving device 4, a tilted upper driving roller 7 and a wedge-shaped driving roller gap 17 are represented. The alignment of the incoming rolled strip 2 in the direction of the coiling device 3 exclusively on the basis of the tilting adjustment of the driving rollers 6 and 7 in relation to each other and the mechanical principles of the transverse displacement of the hot strip in the driving roller gap which can be brought about as a result has already taken place at length in the acknowledgement of German Offenlegungsschrift DE 38 28 356 A1, already cited at the beginning, which hereby becomes part of the description. In addition, to stabilize the running of the strip, the lower driving roller 6 is convexly formed.

The driving device 4, including its drives that are not represented, has, in addition to the task described above of directing and aligning the incoming hot strip in the direction of the coiling device 3, the tasks of tensioning the beginning of the hot strip 2 coming from the finishing train, directing the incoming tip of the strip in the direction of the coiling device 3 and ensuring the draw-back of the hot strip 2 counter to the coiling device 3 during the winding operation.

The coiling device 3 substantially comprises a driven and expanding mandrel 8 for winding up the rolled strip 2 and also, not represented, back-up rollers and guide trays for guiding the rolled strip 2 during the winding operation. To initiate the winding operation, the tip of the hot strip 2 is deflected by the driving rollers 6 and 7 from the plane of the delivery table 1 downward toward the winding mandrel 8. Then, the back-up rollers and the guide trays of the coiling device 3 pass the beginning of the strip several times around the rotating mandrel, the segments of the mandrel 8 being continuously expanded until the rolled strip 2 is wound into lays of coil lying firmly one on top of the other with frictional engagement. The main functions of the coiling device 3 are to ensure the frictional connection of the beginning of the strip and the mandrel 8, to carry the coil 5 produced during winding and to apply defined strip tension to the strip 2 during the winding.

Furthermore, side guide shoes 11, which are arranged at the respective ends of the rollers 9 of the delivery table 1 and can be adjusted laterally onto the edges 10 of the hot strip 2, are provided in the region of the end of the delivery table 1 in order to align the beginning of the hot strip 2 for running into the coiling device 3. The side guide shoes 11 are opened during the coiling operation.

Also arranged in the region of the end of the delivery table 1 is a measuring device 12 for determining the position of the edge of the rolled strip 2 and also a further measuring device 13 for determining the surface geometry of the rolled strip 2, in particular for detecting any "sabre form" of the rolled strip 2. The measuring devices 12 and 13 are preferably arranged upstream of the side guide shoes 11 and downstream of the cooling line (not represented) in the path of the delivery table 1. The measuring device 13 for determining the surface geometry of the rolled strip 2 has a projector 18 and a camera 19 and its function has already been explained in more detail at the beginning in connection with the acknowledgement of German Patent DE 197 09 992 C1, which hereby becomes part of the description.

Figure 3:
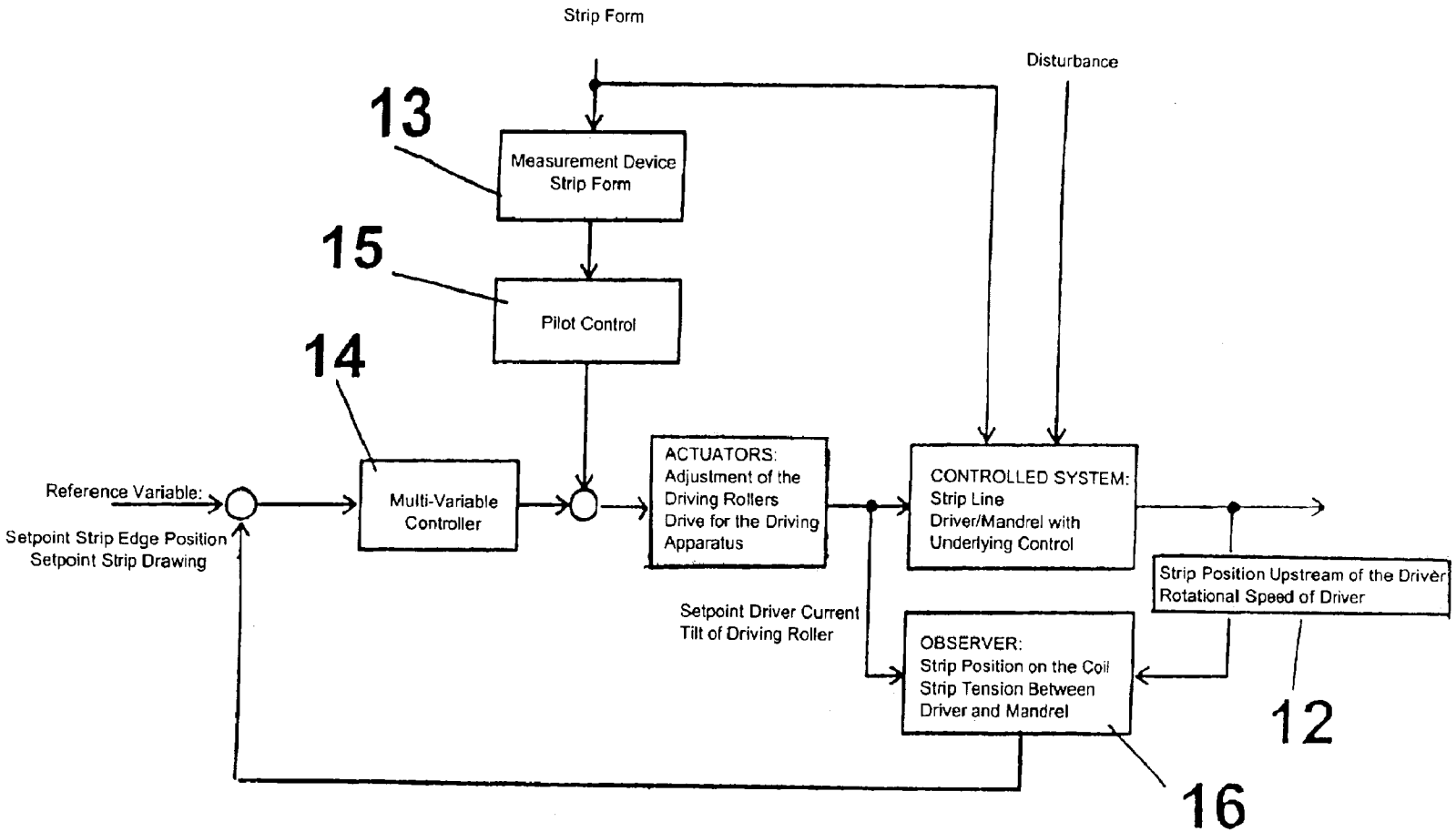

FIG. 3 shows a block diagram of a control loop for a multi-variable control of the strip position of a hot strip 2 in the region of a coiling device 3. It is evident that the manipulated variables for the driving roller adjustment (setpoint driving roller tilting) and the driving roller drive (setpoint strip drawing moment) are determined with the aid of a multi-variable controller 14. In this case, the influence of the surface geometry of the strip, in particular the so-called "sabre" form, is compensated by a pilot control 15. For this pilot control 15, a fictitious transverse bending moment is determined from the result of the strip surface geometry measurement 13 and the strip tension and is compensated by corresponding tilting of the upper driving roller 6, to avoid the rolled strip 2 being driven laterally on account of the surface geometry of the strip.

The strip position on the coil, for the measurement of which so far no methods that can be realized in rolling operation are known, and the strip tension between the driving device 5 and the mandrel 8 are appraised with the aid of observers 16 (model-aided determination of non-measurable variables from measured variables) and fed back for forming the system deviations. For this purpose, the position of the strip edge upstream of the driver is determined by means of the measuring device 12.

As reference variables, the setpoint strip edge position and the setpoint strip tension are fed to the multi-variable controller 14. The reference variable for the strip tension of the driving device 5 is designed such that the complete takeover of the draw-back by the driving device 5 when the rolled strip 2 is unthreaded from the last stand of the finishing train does not take place abruptly, but instead there takes place a steadily differentiatable increase up to full takeover of the tension that already begins before the end of the strip is unthreaded.

The rotational speed of the driving rollers (6, 7), the field current and the field voltage and the armature current and the armature voltage of the motors driving the driving rollers (6, 7), the pressing force of the driving rollers and the bending moment of the strip around the driving rollers are preferably used for the model-aided determination (observers 16) of the actual strip tension.

The strip tension, the driving roller tilt, strip speed, strip position upstream of the driver and surface geometry of the rolled strip are preferably used for the model-aided determination (observers 16) of the actual position of the strip edges.

The control of the drive of the mandrel 8 takes place by a rotational speed control with secondary torque and current control. To control the motor torques, the specific strip data are prescribed. This achieves the effect that the strip tension is adapted to the strip cross-section and is constant over the length of the strip. The control of the drives of the driving rollers 6 and 7 takes place by a speed control with secondary current control. The hydraulic adjustment of the upper driving roller 7 takes place by a force and tilt control.

What is claimed is:

1. A method for the positionally correct winding up of a metal strip in a coiling device, the metal strip, in particular rolled hot strip, being fed to the coiling device by a driving device including driving rollers with a gap between said rollers, the driving rollers being tiltable in relation to one another by a mutli-variable controller by means of actuators for changing the gap between the driving rollers, wherein the controller is fed (a) the position of the edge of the metal strip upstream of the driving device as a measured variable and as a setpoint reference variable, (b) the setpoint strip tension between the driving rollers and the coiling device as a further reference variable, and (c) the surface geometry of the metal strip as a measured variable;

wherein the actual strip tension between said driving rollers and the coiling device is determined by a model-aided determination of measurable variable and is fed to the multi-variable controller as a measured variable; and wherein the driving roller drive and the setting of the driving roller gap are activated by said controller.

2. The method as claimed in claim 1, wherein the determined surface geometry of the hot strip is fed to a pilot control, which is arranged downstream of the controller and upstream of the activation of the actuators of the driving rollers for changing the driving roller gap.

3. The method as claimed in claim 1, wherein the surface geometry of the hot strip is determined before the feeding of the hot strip to the driving device.

4. The method as claimed in claim 1, wherein the rotational speed of the driving rollers, the field current and the field voltage and the armature current and the armature voltage of the motors driving the driving rollers, the pressing force of the driving rollers and the bending moment of the strip around the driving rollers are used for the model-aided determination of the actual strip tension.

5. The method as claimed in claim 1, wherein the actual position of the strip edges of the strip wound up by the coiling device is determined by a model-aided determination of measurable variables and is fed to the multi-variable controller as a measured variable.

6. The method as claimed in claim 5, wherein the strip tension, the driving roller tilt, strip speed, strip position upstream of the driver and surface geometry of the rolled strip are used for the model-aided determination of the actual position of the strip edges.

7. The method as claimed in claim 1, wherein the driving roller gap is set by means of a force and tilt control of the driving rollers.

8. A device for the positionally correct winding up of a metal strip, in particular a rolled hot strip, in a coiling device, with a driving device including driving rollers with a gap between said rollers, tiltable in relation to one another, feeding the hot strip to the coiling device, with actuators and a multi-variable controller for them, for changing the gap between the driving rollers and the resultant influencing of the lateral position of the hot strip, and with a measuring device for determining the position of the edge of the hot strip upstream of the driving device, the measured values of which are fed to the controller, wherein a measuring device for determining the surface geometry of the rolled strip is arranged in the region upstream of the driving device, the measured variable of which device is fed to the controller;

wherein the setpoint strip edge position and the setpoint strip tension are fed to said controller; and an observer module linked to said controller, by which the actual strip tension between the driving rollers and the coiling device can be determined on a model-aided basis from measurable variables.

9. The device as claimed in claim 8, wherein the controller is linked with an observer module, by which the actual position of the strip edges of the strip wound up by the coiling device can be determined on a model-aided basis from measurable variables.

10. A method for the poisitionally correct winding up of a metal strip in a coiling device, the metal strip, in particular rolled hot strip, being fed to the coiling device by a driving device including driving rollers with a gap between said rollers, the driving rollers being tiltable in relation to one another by a multi-variable controller by means of actuators for changing the gap between the driving rollers, wherein the controller is fed (a) the position of the edge of the metal strip upstream of the driving device as a measured variable and as a setpoint reference variable, (b) the setpoint strip tension between the driving rollers and the coiling device as a further reference variable and (c) the surface geometry of the metal strip as a measured variable;

wherein the driving roller drive and the setting of the driving roller gap are activated by said controller; and wherein at the time when the strip is being wound up on its one end, but still partially treated by a finishing stand arranged upstream of the driving device at it other end, the setpoint strip tension is changed such that the draw-back force of the driving rollers for the metal strip wound up by the coiling device is steadily increased before the hot rolled stock leaves the finishing stand with its trailing end and is increased in such a manner, that the driving rollers take over the full draw-back force after the trailing end of the metal strip leaves the finishing stand.

11. The method as claimed in claim 10, wherein the determined surface geometry of the hot strip is fed to a pilot control, which is arranged downstream of the controller and upstream of the activation of the actuators of the driving rollers for changing the driving roller gap.

12. The method as claimed in claim 10, wherein the surface geometry of the hot strip is determined before the feeding of the hot strip to the driving device.

* * * * *